US005240538A

United States Patent [19]

Hyams et al.

[11] Patent Number: 5,240,538

[45] Date of Patent: Aug. 31, 1993

[54] METHOD OF MAKING PADDED STRAPS FOR GARMENTS

[75] Inventors: Al Hyams; Sy Hyams, both of Baldwin, N.Y.

[73] Assignee: Vanity Fair Mills, Inc., N.Y.

[21] Appl. No.: 971,744

[22] Filed: Nov. 4, 1992

Related U.S. Application Data

[62] Division of Ser. No. 826,359, Jan. 27, 1992, Pat. No. 5,165,113.

[51] Int. Cl.[5] ..... B29C 41/02; B32B 31/20

[52] U.S. Cl. ..... 156/245; 156/62.2; 2/2; 2/73; 2/268; 2/338; 264/241; 264/257; 264/258; 450/86

[58] Field of Search ..... 156/62.2, 245; 2/2, 2/268, 73, 338; 604/393; 450/86; 264/241, 257, 258

[56] References Cited

U.S. PATENT DOCUMENTS

| | | | |
|---|---|---|---|
| 2,165,668 | 7/1939 | Vaccaro | 2/15 |
| 2,389,934 | 11/1945 | Rothenberg et al. | 2/268 |
| 2,402,292 | 6/1946 | Nichols | 2/2 |
| 2,425,227 | 8/1947 | Bloom | 223/57 |
| 2,459,648 | 1/1949 | Ingalls | 2/268 |
| 2,478,340 | 8/1949 | Talalay | 2/268 |
| 2,511,483 | 6/1950 | Skirow et al. | 2/268 |
| 2,627,368 | 2/1953 | Jantzen | 223/57 |
| 2,638,603 | 5/1953 | Riedler et al. | 2/268 |
| 2,654,096 | 10/1953 | Riley | 2/268 |
| 2,727,278 | 12/1955 | Thompson | 2/267 |
| 2,752,279 | 6/1956 | Alderfer | 154/100 |
| 2,802,216 | 8/1957 | Vogel | 2/268 |
| 2,858,545 | 11/1958 | Silverman | 2/268 |
| 3,025,859 | 3/1962 | Rosenberg | 2/2 |
| 3,115,878 | 12/1963 | Markham | 450/86 |
| 3,121,878 | 2/1964 | Wilder et al. | 2/268 |
| 3,295,529 | 1/1967 | Corrigall et al. | 450/86 |
| 3,311,112 | 3/1967 | Murray | 450/88 |
| 3,789,098 | 1/1974 | Cole et al. | 223/52 |
| 4,061,813 | 12/1977 | Geimer et al. | 156/62.2 |
| 4,100,924 | 7/1978 | Rosenberg | 450/86 |
| 4,313,776 | 2/1982 | Urai et al. | 156/220 |
| 4,332,633 | 6/1982 | Yamauchi et al. | 2/268 |
| 4,398,981 | 8/1983 | Ellis | 156/245 |
| 4,612,935 | 9/1986 | Greifer | 128/510 |
| 4,638,513 | 1/1987 | Woods | 450/86 |
| 4,795,399 | 1/1989 | Davis | 450/86 |
| 4,795,400 | 1/1989 | Greenberg | 2/268 |
| 4,810,558 | 3/1989 | Hornung et al. | 428/159 |
| 4,886,697 | 12/1989 | Perdelwitz et al. | 604/393 |
| 4,894,868 | 1/1990 | Christopher | 2/268 |
| 4,945,576 | 8/1990 | Melton | 2/268 |
| 4,953,233 | 9/1990 | Moshier | 2/268 |

FOREIGN PATENT DOCUMENTS

| | | | |
|---|---|---|---|
| 3839051 | 2/1990 | Fed. Rep. of Germany | 2/268 |
| 2027976 | 2/1987 | Japan | 2/24 |
| 586521 | 4/1977 | Switzerland | 2/268 |

*Primary Examiner*—Caleb Weston
*Attorney, Agent, or Firm*—Pennie & Edmonds

[57] ABSTRACT

A padded strap for brassieres and similar garments that includes an integral molded pad portion. The strap, including the pad, is suitable for forming the load-bearing straps of the qarment while presenting an attractive, smooth and seam-free outer appearance and also being free of seams along the wearer's skin. The padded strap of the invention also may be used as a separate pad for a conventional strap by attaching appropriate hooks or other hardware to the ends of the strap. A method for forming a strap according to the invention is also disclosed. The method includes laminating selected fabrics to a resilient core to form a laminated sandwich, molding the sandwich under pressure and temperature to compress a portion and leave an uncompressed portion to form a pad portion, cooling the molded sandwich in a curved position to induce a curved set, cutting the molded sandwich to size to form a strap, and securing the strap to a garment.

17 Claims, 3 Drawing Sheets

METHOD OF MAKING PADDED STRAPS FOR GARMENTS

This is a division of application Ser. No. 07/826,359, filed Jan. 27, 1992 now U.S. Pat. No. 5,165,113.

BACKGROUND OF THE INVENTION

The present invention relates to padded straps for garments and, in particular, laminated straps, having an integral molded pad portion, for brassieres and similar garments. The present invention also relates o a method for making such padded straps.

The problems encountered by full-figured women in wearing garments which support the breasts are well known, and well documented in the U.S. patent literature. For example, U.S. Pat. No. 4,638,513 to Woods discusses the problems associated with depressions formed in a woman's shoulder due to the pressure of the strap. Woods proposes a layered and sewn elastic strap as a means of solving this problem. Numerous other United States patents, for example, U.S. Pat. Nos. 4,795,399, 4,612,935 and 4,945,576 disclose various configurations of pads for placement on or under brassiere straps to diffuse and spread the load of the strap on the shoulder.

Although considerable effort has been devoted to solving these problems, the various prior art solutions have been less than successful for a number of reasons. First, although separate pads can provide a useful addition to a favorite garment, it is desirable that the pad structure be incorporated directly into the strap. The reasons for this include the attractiveness of the garment itself, the provision of a smooth outer appearance for the wearer's clothes and the fact that separate pads can become lost or misplaced.

Further problems are presented by layered straps having sewn in layers of padding. It such straps there is a tendency for the layers to wear and wash differently, causing the strap to bunch and the layers to separate over time. Even if such wear and bunching does not lead to a loss of function of the strap, it does degrade the appearance sufficiently to make the garment in which it is included visually unattractive. Another detriment to known pads and padded straps is the presence of seams which present either an unattractive outer appearance or an irritant to the skin when turned inward.

Additionally, there is the problem of stability or curling of the strap to form a "V" when tension is exerted on the ends of the strap. This problem was addressed in the Woods patent (discussed above), however, the solution disclosed therein includes a strap having sewn together layers with surface undulations or wrinkles. These wrinkles can present an unattractive and worn outer appearance even in a new garment.

Thus, there continues to be a need in the art for a padded strap for brassieres and similar garments that follows the contour of the shoulder, provides comfort for the wearer and, at the same time, provides an attractive appearance that is maintained over time after numerous washings of the garment.

SUMMARY OF THE INVENTION

It is therefore an object of the present invention to provide a strap which alleviates the discomfort and depressions formed in a woman's shoulder while wearing a brassiere or similar garment employing the strap.

It is also an object of the invention that the strap provide a smooth and attractive outer appearance, free of seams, wrinkles or bunching even after extended use, including repeated washings.

It is a further object of the invention to provide an add-on pad for a brassiere or similar garment strap, which pad also exhibits an attractive appearance and acceptable wearing and washing characteristics.

Another object of the present invention is to provide a method for making such a padded strap for brassieres or similar garments.

The padded strap according to the invention comprises a three layer laminated sandwich of materials that is then molded to provide an integral pad portion to be disposed against the wearer's skin. The strap as a whole is free of seams and generally will not bunch or wrinkle over time. A resilient, padded material is used as a core material and suitable fabrics having a desired outer appearance and feel against the skin are laminated thereto. The strap according to the invention thus provides a single integral piece including a pad portion that may be sewn into the garment to provide load bearing straps. The uniform bonding between the laminated layers and the compressed structure surrounding the pad portion presents a smooth and attractive outer appearance while providing the necessary resistance to wear and washing.

The strap, according to the present invention, is also suitable to be used as a separate pad by providing appropriate hooks or other hardware at each end.

I the method according to the invention, selected fabrics are laminated to a padded core material, preferably a resilient and flexible foam. The laminated sandwich is then placed in a mold to form a strap blank with the pad, base and tab portions. Under heat and pressure, the mold compresses a portion of the sandwich while leaving a portion uncompressed to form the pad portion of the strap. The compressed portion forms the base portion which provides the smooth outer appearance and lateral stability for the strap. The compressed portion also forms the tab portion for securing the strap to a garment.

After molding, the strap blank is placed in a curved cooling trough to induce a curved set which approximates the curve of the wearer's shoulder. The curved set can be further induced by the use of an appropriately curved mold. The cooled strap blank is then die cut to the desired shape with the pad portion disposed thereon. The strap is sewn into a garment or provided with hooks or other hardware for securing the strap to a conventional brassiere strap.

DETAILED DESCRIPTION OF THE PREFERRED EMBODIMENTS

Figure 1A:
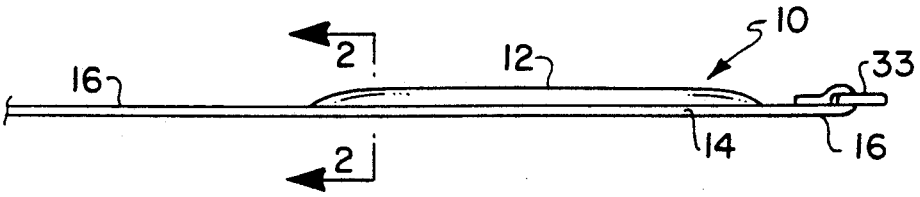
FIGS. 1A and B are a side view and bottom plan view, respectively, of a padded strap according to the present invention.
Figure 2:
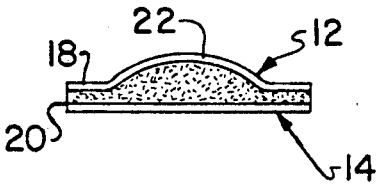
FIG. 2 is a cross-sectional view along line 2—2 in FIG. 1A.

Referring to FIGS. 1A and B, padded strap 10 according to the present invention comprises three general portions: pad portion 12, base portion 14 and tab portions 16. Strap 10 is made from a laminated, sandwich-type construction as shown in FIG. 2. Top fabric layer 18 and bottom fabric layer 20 are uniformly bonded to core material 22. The layers are molded under high pressure and temperature and cooled to achieve a permanent set in the desired final shape. The method for forming the padded strap is a further aspect of the invention, discussed in detail below.

For reasons of clarity, the top and bottom fabric layers are shown in the figures as each comprising only a single layer. It is to be understood that top layer fabric 18 and bottom fabric layer 20 could each be formed of multiple fabric layers to provide particular desired qualities. It is to be further understood that "permanent" as used herein and in the claims refers to a condition intended to continue so long as the invention is employed under normal conditions of use.

The strap according to the invention has been discovered to be superior to prior art strap pads or padded straps in terms of comfort, wear, washability, and look and feel. In particular, the strap of the present invention does not require seams, which adds both to the comfort and appearance. The ability to easily use flexible and resilient foams as core material 22 is a further advantage. Such foams have greater resilience and longer life than fiberfill or batting materials typically used in prior art pads and straps. Also, the strap is well suited to the use of nylon-lycra materials as top and bottom fabrics 18, 20 which are preferred for their luster, resilience, wearability and washability. The improved wearability and washability of the invention means that the strap and integral pad do not bunch, separate or curl over time, particularly after repeated washing.

In use, padded portion 12 lies against the wearer's skin and provides the padding necessary to spread the load and prevent the strap from cutting into the wearer's shoulder. Base portion 14 supports the pad portion and presents the desired smooth and seam free outer appearance. The combination of the base portion and pad portion also provides lateral stability, that is, the strap does not tend to curl or otherwise become deformed across its width when tension force is applied to the ends. Tab portions 16 are used to secure the strap to the garment, whether by sewing or otherwise.

Figure 3:
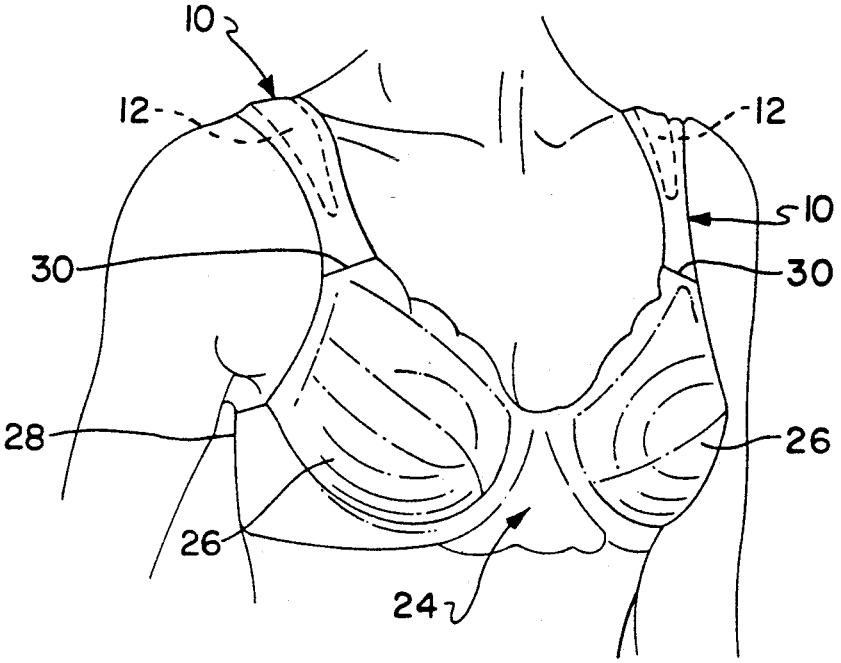
FIG. 3 illustrates a brassiere employing the padded strap according to the present invention.

FIG. 3 illustrates a brassiere 24 having padded straps 10 directly sewn into the garment. As is well known, cups 26 directly support the breasts and back strap 28 assists in holding the cups in place. This arrangement is generally incorporated into any garment that includes support for the breasts. However, in some garments, for example swim suits, the function of the back strap may be assumed by the garment itself.

In the present invention, straps 10, directly secured to cups 26 at seams 30, form the load bearing straps of the garment. Adjustable attachments may be provided at the front or back. In use, pad portions 12 lie against the wearer's skin. The location of pad portion 12 on the inner side of the garment are indicated in dashed lines. Such a construction provides further advantages over prior art pads which had to be separately attached and therefore could slip out of place or be lost when the qarment was not in use. Additionally, this construction allows strap 10 to be easily and attractively incorporated into other types of garments that include support for the breast, such as swim suits, halter tops, athletic wear or slips.

Figure 1B:
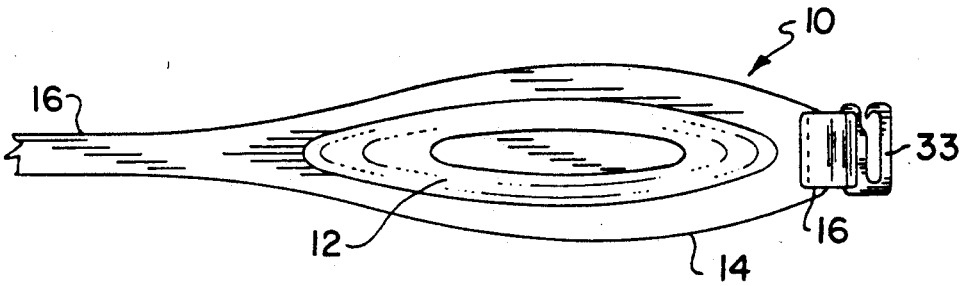

Alternatively, if desired, strap 10 may be fitted at the ends with hooks, such as hook 33 (shown in FIG. 1), loops or other suitable fastening devices to allow the strap to be separately attached to a conventional brassiere strap. By this means a woman may gain the comfort features of the present invention without having to replace her existing brassieres.

Referring now to FIGS. 4–10, the method for making the padded strap according to the present invention may be explained in greater detail. First, the materials from which the strap is to be made must be selected. Based on the teachings of the present invention, a person of ordinary skill in the art could select a wide variety of fabrics and core materials which would be suitable for the molding process described herein. Other than the general suitability for the molding process as described, important factors are the desired final appearance, strength and wear resistance.

A preferred material for core 22 is an ester-polyurethane foam having a density of about 1.6 pounds per cubic foot. Ester-polyurethane foam provides excellent resilience and resistance to yellowing when subjected to the high temperatures of the molding process. Other flexible and resilient foams, for example ether-polyurethane and other polyurethanes, can be used for core material 22. Some of these materials may have a greater tendency to yellow, which may not be a relevant consideration if the strap is made in black or other colors where the yellowing would not show. Other materials exhibiting suitable resilience and flexibility can be used (for example fiberfill).

A preferred material for top fabric layer 18 and bottom fabric layer 20 is nylon-lycra comprising about 88% nylon and 12% lycra, with a weight of about 7.9 ounces per square yard. This fabric possesses desired heat resistance, shiny appearance, strength, wear resistance and elastic memory. Again, a person skilled in the art could identify many different fabrics, for example, various laces, polyester fabrics and plain or simplex tricot, which would be suitable for use with the present invention.

Figure 4:
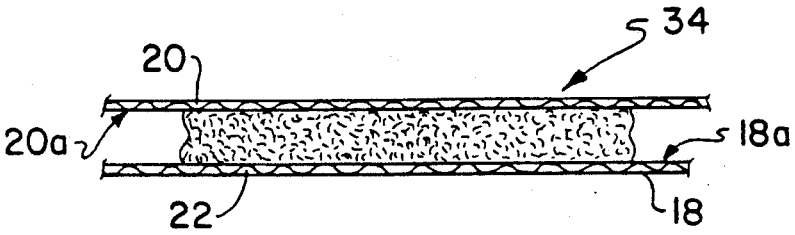
FIG. 4 is a cross-sectional view of an example of the laminated foam/fabric sandwich of the invention.

The selected fabrics are bonded together to form a moldable, integral, laminated sandwich 34, as shown in FIG. 4. In a preferred embodiment, core 22 is approximately one-quarter inches thick. Commercially available water-base, non-allergenic acrylic adhesive is used to bond the layers together. A suitable acrylic adhesive is available from American Finish & Chemical Co. of Chelsea, Mass. under the tradename S1154. The adhesive is spread evenly over the entire surfaces (18*a* and 20*a*) to be joined to ensure a uniform and smooth final appearance. Other types of adhesives, such as a toluene-base cement, may also be used if compatible with the fabric and core material selected.

Another means for bonding the layers together is heat fusing. This can be accomplished by selecting a material for the top and bottom fabrics that is directly heat fusible to the core material or by placing an additional layer of heat fusible material between the fabric layer and core material.

Figure 5:
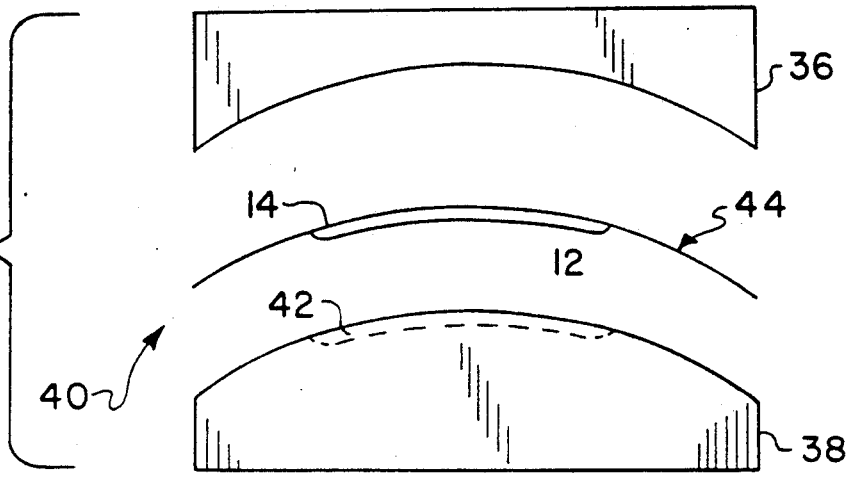
FIG. 5 is a side view of an open curved mold according to the present invention, with a strap blank disposed between the mold parts.
Figure 6:
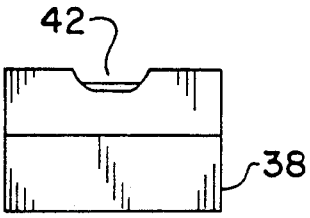
FIG. 6 is an end view of the curved lower mold part shown in FIG. 5.
Figure 7:
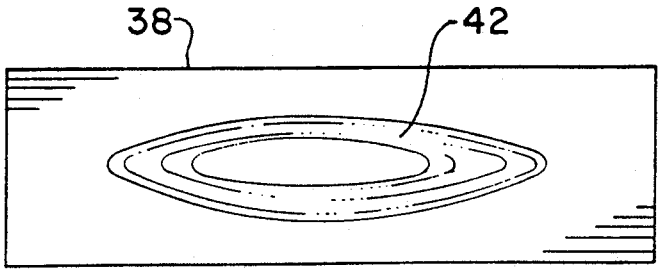
FIG. 7 is a top plan view of the lower mold part shown in FIG. 5.
Figure 8:
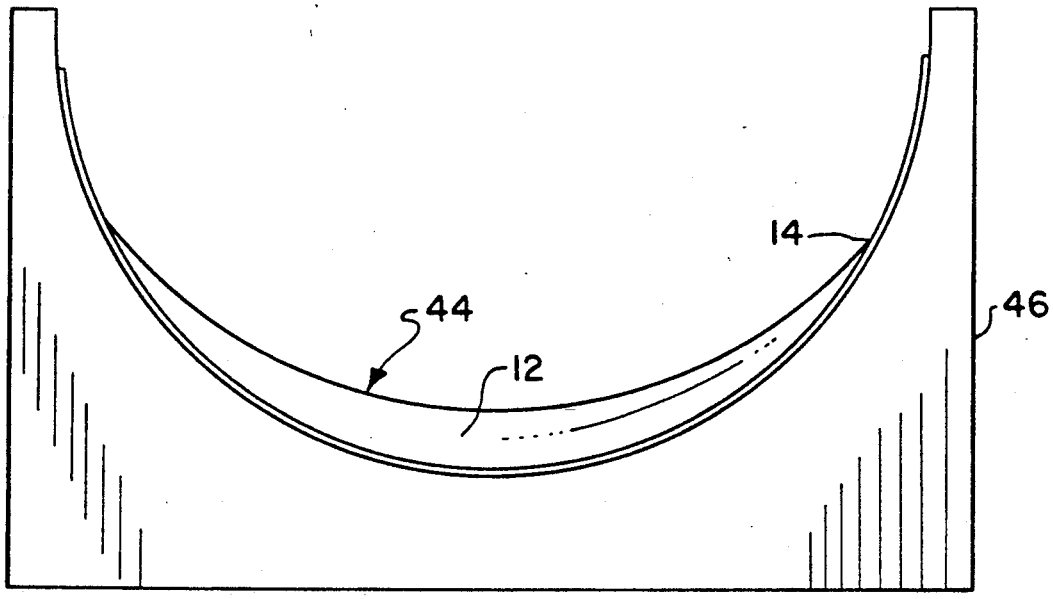
FIG. 8 is an end view of a cooling trough containing a padded strap blank according to the present invention.

Sandwich 34 is cut to rough size and placed between first mold part 36 and second mold part 38 of curved mold 40, shown in FIG. 5. The orientation of the mold may also be inverted from that shown in FIG. 5. The mold parts are preferably constructed from aluminum and have a radius of curvature of about four inches. Second mold part 38 (shown also n FIGS. 6 and 7) is provided with recess 42, which receives and forms pad portion 12 during the molding process. The peripheral shape of recess 42 therefore matches the desired shape of pad portion 12. It will be appreciated that pad portion 12 may be formed in essentially any desired shape. The depth of recess 42 typically will be sufficient so as not to compress the core material over the majority of the area of the pad portion. This allows the greatest possible amount of padding. However, in certain instances it may be desirable to compress the pad portion to a degree in order to achieve a particular end product.

During the molding process, mold 40 is maintained at a temperature between approximately 250° F. and 475° F., and preferably between about 300° F. and 425° F. With the combination of ester-polyurethane foam core material and nylon-lycra fabric described above, the most preferred temperature range is about 375° F. to 425° F. In order to reduce or prevent yellowing of the fabric, the exact operating temperature must be determined on a trial basis due to variations in fabric dye lots. A higher temperature is in most cases preferred because it reduces the molding time. However, too high a temperature will cause the fabric and/or core to yellow or otherwise degrade. Molding times typically will be in the range of 10 to 80 seconds, more preferably between about 15 to 60 seconds.

The molding time and temperature can also depend upon ambient temperature. For example, with an ambient temperature of about 70° F.–75° F., good results have been achieved with the nylon-lycra and ester-polyurethane foam combination described using a mold temperature of about 405° F. and a time of about 30 seconds.

After sandwich 34 is in place on the hot mold, the mold parts are closed under pressure. The pressure applied is generally within the range of about 65 to about 125 psi and preferably between about 70 to 90 psi. Most preferably the pressure is about 80 psi, however, this also may vary for different materials and conditions. The combination of heat and pressure permanently compresses the core material to form base portion 14 and tab portions 16, while leaving pad portion 12, received in recess 42, substantially uncompressed. With the one quarter inch thick foam described above, the compressed thickness is about 0.08–0.1 inches, including the fabric layers. Mold 40 is mounted in a known molding press (not shown), which regulates the temperature of the mold and provides the molding pressure. The operation and construction of such presses are understood by persons of ordinary skill in the art.

After the required time, mold 40 is opened and strap blank 44, with pad portion 12 formed thereon, is removed. The hot strap blank is placed in cooling trough 46 and allowed to cool to room temperature. Cooling trough 46, shown in FIG. 8, preferably has an inside radius of curvature of about four inches. By allowing strap blank 44 to cool in a curved position, similar to the position strap 10 will assume on the shoulder, the strap assumes a curved set. The curved set provides a superior product because when strap 10 is placed over the shoulder it has less of a tendency to bunch along top fabric 18 (which is aqainst the shoulder when worn) as compared to a typical prior art flat strap. It is also believed that the curved mold contributes to the curved set.

Figure 9:
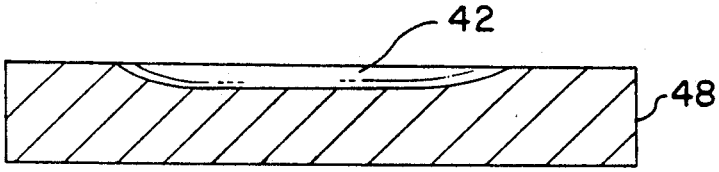
FIG. 9 is a cross-sectional view of an alternative embodiment of flat mold according to the present invention.

It is possible to use a flat mold for forming the strap according to the invention. FIG. 9 illustrates flat second mold part 48 which mates with a flat first part to make up a flat mold similar to mold 40. The hot, flat molded strap blank can then be placed in cooling trough 46 to impart the curved set. It is to be understood that the curved set is a further refinement of the present invention, which is not required in order to achieve the overall general advantages of the invention.

The cooled strap blank 44 is cut to the desired overall shape, leaving a predetermined amount of base portion 14 surrounding the pad portion 12 to provide sufficient strength and lateral stability. Cutting may be readily accomplished by known by die cutting techniques. Strap 10 thus formed may be sewn directly into a garment as shown in FIG. 3.

Figure 10:
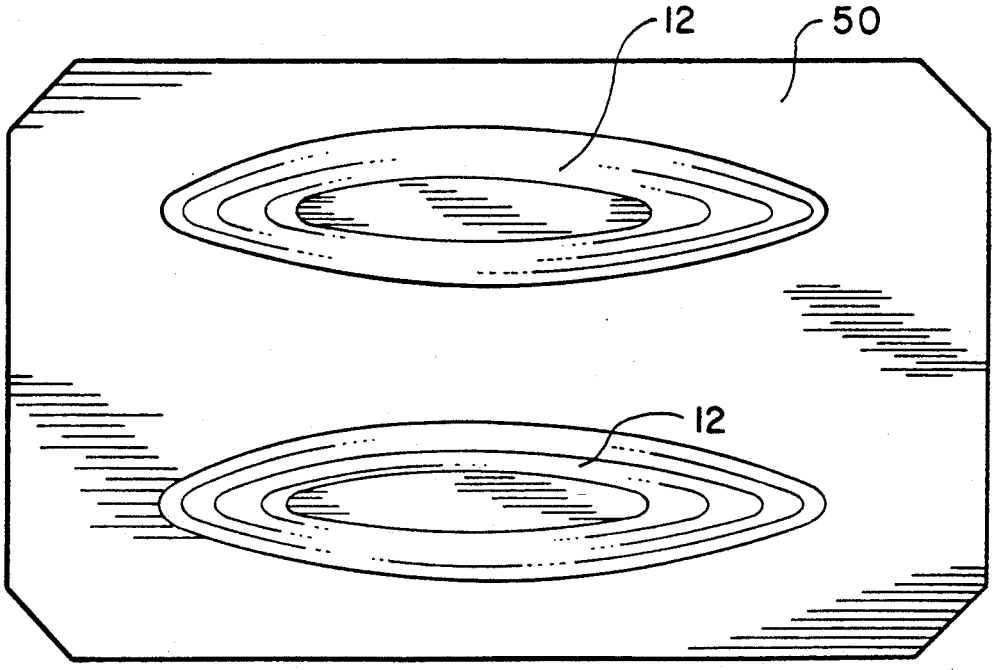
FIG. 10 is a top perspective view of a gang molded strap blank according to the present invention, prior to die cutting.

In order to increase the speed of production, multiple strap blanks may be gang molded, as shown in FIG. 10. Strap blank 50 includes two pad portions 12 gang molded from a single laminated sandwich. Individual straps 10 are then die cut from blank 50. Two pad portions are shown in FIG. 10 for illustration purposes only. It will be immediately appreciated that any number of pad portions may be gang molded from a single laminated sandwich of appropriate size.

What is claimed is:

1. A method for making a padded strap for a garment, comprising:

providing a resilient moldable member;

molding said member to permanently compress a portion of said member and define an uncompressed portion forming a pad portion on the molded member;

cutting the molded member to form a strap with said pad portion disposed thereon; and providing means for securing said strap to the garment.

2. The method according to claim 1, further comprising inducing a curved set into the molded member prior to cutting.

3. The method according to claim 2, wherein:

said molding includes heating the moldable member to an elevated temperature; and said inducing comprises cooling the molded member in a curved position with the pad portion disposed in the direction of the inside of the curve.

4. The method according to claim 3, wherein inducing the curved set further comprises molding the member between mold parts curved in the direction of the set.

5. The method according to claim 1, wherein said step of providing a moldable member comprises:

providing a resilient core material;

bonding a first fabric layer to one side of the core material over a first area of contact at least as large as the strap to be formed, wherein said bonding is substantially uniform and complete across the entire first area of contact; and bonding a second fabric layer to the opposite side of the core material over a second area of contact substantially the same size as said first area, wherein said bonding is substantially uniform and complete over the entire second area of contact.

6. The method according to claim 1, wherein said molding step comprises:

placing the moldable member between two mating mold parts, wherein one mold part defines a recess having a peripheral shape substantially the same as the peripheral shape of the padded portion to be formed, said recess forming a cavity when the mold parts are closed together;

heating the mold parts;

closing the mold parts on the moldable member such that the portion of the moldable member located between the mating parts is permanently compressed and the portion located over the recess is contained in the cavity and substantially uncompressed.

7. The method according to claim 1, wherein the step of providing means for securing the strap to a garment comprises permanently fixing the strap into the garment to form the primary load bearing member over a wearer's shoulder.

8. The method according to claim 5 wherein said bonding comprises heat fusing the fabric layers to the core material.

9. The method according to claim 5 wherein said bonding comprises placing an acrylic adhesive between the fabric layers and the core material.

10. The method according to claim 9 wherein the core material is a foam or fiber fill material.

11. The method according to claim 10 wherein the foam is a polyurethane foam.

12. The method according to claim 11 wherein the fabric layer is nylon-lycra and the foam is ester-polyurethane.

13. The method according to claim 1, further comprising bonding at least one fabric layer to a core material substantially uniformly and completely over a bonded surface to form said resilient moldable member.

14. The method according to claim 13 wherein said bonding comprises placing adhesive between said fabric layer and core material.

15. The method according to claim 14 wherein the core material is a foam or fiber-fill material.

16. The method according to claim 15 wherein the foam is a polyurethane foam.

17. The method according to claim 16 wherein said fabric layer is nylon-lycra and the foam is ester-polyurethane.

* * * * *